US005772928A

United States Patent [19]

Holtzman

[11] Patent Number: 5,772,928

[45] Date of Patent: Jun. 30, 1998

[54] NEEDLE AND SEAT VALVE ASSEMBLY

[76] Inventor: Barry L. Holtzman, 2801 Thatcher Ct., Bloomington, Ind. 47401

[21] Appl. No.: 664,187

[22] Filed: Jun. 14, 1996

[51] Int. Cl.[6] ..... F02M 5/12

[52] U.S. Cl. ..... 261/67; 261/70; 137/435; 137/436

[58] Field of Search ..... 261/67, 70; 137/435, 137/436

[56] References Cited

U.S. PATENT DOCUMENTS

| | | | |
|---|---|---|---|
| 735,912 | 8/1903 | Schrotz . | |
| 985,122 | 2/1911 | Ashmusen . | |
| 1,125,046 | 1/1915 | Beebe . | |
| 1,223,170 | 4/1917 | Hodgson | 137/436 |
| 1,682,039 | 8/1928 | Feagles . | |
| 1,915,490 | 6/1933 | Gere . | |
| 2,064,247 | 12/1936 | Evans . | |
| 2,254,850 | 9/1941 | Mallory . | |
| 2,258,271 | 10/1941 | Walter . | |
| 2,559,135 | 7/1951 | Townley . | |
| 2,624,414 | 1/1953 | Harrell et al. . | |
| 2,656,165 | 10/1953 | Bimberg | 137/435 |
| 2,717,149 | 9/1955 | Anderson . | |
| 2,970,822 | 2/1961 | Ernest . | |
| 3,034,529 | 5/1962 | Kittler . | |
| 3,077,341 | 2/1963 | Schlichting . | |
| 3,292,896 | 12/1966 | Marsee et al. . | |
| 3,424,431 | 1/1969 | Grose | 137/436 |
| 3,605,949 | 9/1971 | Vock . | |
| 3,620,511 | 11/1971 | Reinhardt et al. . | |
| 3,871,403 | 3/1975 | Grose | 137/436 |
| 4,290,455 | 9/1981 | Honda et al. . | |
| 4,371,000 | 2/1983 | Shinoda et al. . | |
| 4,494,562 | 1/1985 | Stephens | 137/436 |
| 4,718,449 | 1/1988 | Ralph | 137/436 |
| 4,750,522 | 6/1988 | Griffin et al. . | |
| 5,370,156 | 12/1994 | Paracchio et al. . | |
| 5,421,368 | 6/1995 | Maalouf et al. . | |

FOREIGN PATENT DOCUMENTS

| | | | |
|---|---|---|---|
| 0193264 | 9/1986 | European Pat. Off. | 261/70 |

OTHER PUBLICATIONS

*Olav Aaen's Carb Tuning Handbook,* Aaen Performance literature 1990, Chapter 2, "Fuel Supply & The Inlet Valve," pp. 8–11.

*Weber Carburetors,* Pat Braden, HPBooks 1988, chapter 3, "Carburetor Operation, Float & Needle Valve", pp. 21, 22.

*Primary Examiner*—Tim R. Miles

*Attorney, Agent, or Firm*—Barnes & Thornburg

[57] ABSTRACT

A valve assembly is provided for controlling the flow of fuel to the fuel chamber of a carburetor. The valve assembly includes a housing and a needle. The housing includes a side wall defining an inlet, an outlet in fluid communication with the inlet, and an interior region between the inlet and outlet. The needle is received in the interior region of the housing for movement therein between a closed position blocking the flow of fuel between the inlet and the outlet and an open position allowing the flow of fuel between the inlet and the outlet. The needle includes a post and a skirt fixed to the post. The skirt extends outwardly from the post and cooperates with the side wall to restrict the flow of fuel therebetween dampening the movement of the needle relative to the housing so that the needle moves with the housing when the housing vibrates in response to the operation of the engine.

25 Claims, 5 Drawing Sheets

NEEDLE AND SEAT VALVE ASSEMBLY

BACKGROUND AND SUMMARY OF THE INVENTION

The present invention relates to a valve for controlling the flow of fuel to a carburetor of an engine, and particularly to a needle and seat valve assembly for controlling the flow of fuel to a fuel chamber of a carburetor. More particularly, the present invention relates to a needle and seat valve assembly including a housing having a valve seat and-a needle that is movable relative to the housing and the valve seat between a closed position sealingly engaging the valve seat blocking the flow of fuel to the fuel chamber and an open position away from the valve seat allowing the flow of fuel to the fuel chamber.

Carburetors in internal combustion engines create an atomized spray of gasoline for the engine so that the engine is supplied with a mixture of fuel and air that the engine can efficiently burn. The carburetor typically includes a fuel chamber which is a fuel reservoir regulating the fuel supply in the carburetor. Typically, a fluid valve or fuel inlet valve is positioned to lie in a conduit connecting the fuel chamber to an engine fuel tank or other fuel supply to control the flow of fuel into the fuel chamber.

There are various types of fuel delivery systems in carburetors. For example, the carburetor can include a pressure chamber storing pressurized fuel. The pressure of the fuel in the chamber of such carburetors is typically controlled by a diaphragm that is coupled by an actuator to the fuel inlet valve. The fuel inlet valve of such carburetors typically moves in response to movement of the diaphragm. Another type of carburetor can include a float chamber storing fuel near atmospheric pressure. The fuel level in the float chamber is controlled by a float in the float chamber that is coupled by an actuator to the fuel inlet valve. The operation of the fuel inlet valve is similar for each type of carburetor and is described below for the carburetor including a float chamber.

The fuel inlet valve is movable between a closed position blocking the flow of fuel between the fuel supply and the fuel chamber and an open position allowing the flow of fuel from the fuel supply to the fuel chamber. Thus, when the level of fuel in the fuel chamber is below a predetermined minimum level, the float allows the fuel inlet valve to move to the open position allowing fuel to flow into the fuel chamber. When the level of fuel is restored to a predetermined maximum level, the float acts upon the fuel inlet valve to move the fuel inlet valve to the closed position. For example, U.S. Pat. No. 4,371,000 to Shinoda et al. discloses a float chamber formed having an inlet passage and an outlet passage. A float is mounted within the float chamber and acts on a fluid valve for controlling fuel flow into the float chamber through an intake passage.

Conventional fuel inlet valves include a housing having an inlet, an outlet in fluid communication with the inlet, and a needle movable relative to the housing between the closed position and the open position. Typically, the needle is stream-lined and fits loosely in the housing so that the cross-sectional area between the needle and the housing for fuel flow is large compared to the size of the inlet opening. In addition, it is known to provide a damper spring having a first end engaging the needle and a second end engaging a damper ball or damper plunger, the ball or plunger being coupled to or engaging an arm coupled to the float. For example, the Shinoda '000 patent discloses a needle valve element formed to include a central cylindrical hole supporting a needle valve actuating element. Between the actuating element and the needle valve element there is provided a compression coil spring for the purpose of buffering action. The lower end of the needle valve actuating element abuts an actuating projection which is mounted on the float pivot arm. In addition, U.S. Pat. Nos. 2,717,149 to Anderson; 2,559,135 to Townley; and 2,258,271 to Walter each disclose a needle valve assembly including a housing, a needle received in the housing, and a spring yieldably biasing the needle toward the valve seat.

It is also known to provide a fuel inlet valve having a fuel flow passage extending therethrough to reduce frictional losses due to changes in fuel flow direction. For example, U.S. Pat. No. 3,292,896 to Marsee et al. discloses a needle valve designed to increase the flow of fuel through a valve seat without increasing the diameter of the valve seat to avoid operating at higher pump pressures and thus avoid redesigning the float system to provide sufficient buoyancy at the higher pump pressures. The Marsee '896 patent discloses that the mere addition of a frustro-conical passage and offsetting the discharge passages increased the flow capacity of the valve. The Marsee '896 patent also discloses that the increased flow efficiency is due both to the spatial relationship of the discharge openings and the frustro-conical surface to each other and to the shape and position of the conical valve tip when the valve is open.

However, although vibration isolating carburetor mounts are known, the prior art, including the Marsee '896 patent, appears to have overlooked the impact of vibration transmitted from the engine on the flow rate of fuel through the fuel inlet valve and does not appear to suggest or disclose features to cure the problem of movement of the needle valve relative to the seat caused by engine vibration. Conventional needle valve-type fuel inlet valves include a needle valve that is movable by the float and that is freely movable relative to the housing. In such systems, the needle is effectively decoupled from the carburetor and housing of the fuel inlet valve. Thus, at least at certain engine vibration frequencies, vibration of the carburetor and the needle valve housing resulting from the operation of the engine is independent of the movement of the needle.

As the housing vibrates, inertia prevents vibration of the needle at the vibration amplitude of the housing. Thus, the needle oscillates relative to the housing moving alternately toward the open position and toward the closed position. When the fuel level in the float chamber is low and the float arm moves away from the needle, the needle is expected to move away from the seat to allow the flow of fuel into the float chamber. However, engine vibration is transmitted to the housing and vibrates the housing so that the needle, instead of staying away from the seat, oscillates relative to the housing and blocks the flow of fuel between the fuel supply and the fuel chamber at least during a portion of the oscillation cycle. The resulting reduction of fuel flow to the engine can cause a loss of engine power, can cause the engine to stall from lack of fuel, and can even cause engine damage at high engine operating frequencies (rpm).

What is needed is a needle and seat fuel inlet valve assembly for fuel flow control that allows the flow of fuel between the fuel supply and the float chamber to be maximized at all engine operating frequencies. The needle of such a needle and seat valve assembly should be coupled to the housing for movement therewith when the housing vibrates at frequencies typically caused by the operation of the engine while also being moveable relative to the housing in response to movement of the actuator. Users of the improved needle and seat fuel inlet valve assembly would appreciate such an assembly that can operate even at high engine operating frequencies to ensure a steady flow of fuel to the carburetor.

According to the present invention, a valve assembly is provided for controlling the flow of fuel to the fuel chamber of a carburetor. The valve assembly includes a housing having a side wall defining an inlet, an outlet in fluid communication with the inlet, and an interior region therebetween. A needle is received in the interior region of the housing for movement relative to the housing between a closed position blocking the flow of fuel between the inlet and the outlet and an open position allowing the flow of fuel between the inlet and the outlet. The needle includes a post and a skirt fixed to the post and extending outwardly therefrom. The skirt cooperates with the side wall to restrict the flow of fuel between the skirt and the side wall. Restricting the flow of fuel between the skirt and the side wall dampens the movement of the needle relative to the housing so that the needle moves with the housing when the housing vibrates in response to the operation of the engine.

In preferred embodiments, the needle and seat valve assembly in accordance with the present invention includes a housing having a side wall defining a generally cylindrical interior region. The housing is formed to include an inlet in fluid communication with a fuel supply, a seat defining the inlet, and an outlet in fluid communication with the inlet and in fluid communication with the float chamber of the carburetor. The interior region is positioned to lie between the inlet and the outlet. A needle is received in the interior region of the housing for movement between a closed position sealingly engaging the seat and blocking the flow of fuel between the inlet and the outlet and an open position spaced apart from the seat and allowing the flow of fuel between the inlet and the outlet.

The needle is coupled to a float that is movably mounted in a float chamber of the carburetor so that the needle moves relative to the housing between the closed position and the open position in response to the position of the float in the float chamber. The position of the float varies in response to the level of fuel in the float chamber so that when the fuel level is low, the float moves the actuator moving the needle to the open position allowing fuel to flow from the fuel supply through the inlet, the interior region, and the outlet of the needle and seat valve assembly to the float chamber. Once the level of fuel in the float chamber is restored to a predetermined maximum level, the float moves the actuator moving the needle to the closed position, sealingly engaging the inlet to block the flow of fuel from the fuel supply to the float chamber.

The housing of the needle and seat valve assembly is fixed to the carburetor and the carburetor is fixed to an engine. As the engine operates, features inherent in the engine cause the engine to vibrate, primarily at vibration frequencies equivalent to the engine operating frequency (rpm). The vibration of the engine is transmitted to the carburetor and to the housing of the needle and seat valve assembly. In conventional needle and seat valve assemblies, the needle is decoupled from the housing so that when the housing vibrates, inertia of the needle prevents the needle from vibrating with the housing. Thus, the vibration of the housing at the relatively rapid operating frequencies of the engine and the inertia of the needle which tends to prevent the needle from vibrating with the housing cause the needle to move rapidly relative to the housing or to "chatter" between the open position and the closed position when the engine, the carburetor, and the housing vibrate, particularly at high engine rpm.

When the level of fuel in the float chamber is at a predetermined minimum level, the float is away from the needle to allow the needle to move to the open position maximizing the flow of fuel between the inlet and the outlet. However, as described above, the undesired vibration of the housing instead can cause the needle to oscillate relative to the housing and chatter between the open position and the closed position. This chattering of the needle disrupts the flow of fuel between the fuel supply and the float chamber and reduces the amount of fuel supplied to the carburetor. An inadequate supply of fuel to the float chamber can cause an inadequate supply of fuel to the engine resulting in a loss of engine power or even damage to the engine when operating at high engine rpm.

The needle and seat valve assembly in accordance with the present invention includes a mechanism that prevents the rapid chattering of the needle within the housing while still allowing the relatively slow movement of the needle in response to movement of the float. An annular skirt is attached to the needle and extends radially outwardly toward the side wall of the housing to form an annular gap between the side wall and the skirt. The skirt cooperates with the housing to restrict the flow of fuel through the gap. However, fuel must flow through the gap between the skirt and the housing for the needle to move relative to the housing.

As the housing vibrates rapidly in response to vibration of the engine, each vibration cycle operates first to vibrate the housing in a first direction and then to vibrate the housing back in a second direction opposite to the first direction. Each vibration cycle repeats this movement of the housing. The gap between the skirt and the side wall of the housing is sized so that the fuel cannot flow through the gap quickly enough to allow significant movement of the needle relative to the housing in the first direction before the vibration cycle changes the direction of vibration and moves the housing in the opposite second direction. Likewise, the fuel cannot flow through the gap quickly enough to allow significant movement of the needle relative to the housing in the second direction before the vibration cycle again changes the direction of vibration of the housing back to the first direction. Thus, the fuel cooperates with the skirt and the side wall to couple the needle to the housing so that the needle moves with the housing in response to vibration transmitted to the housing from the engine.

At the same time, however, the restriction of the flow of fuel through the gap does not significantly hinder the movement of the needle in response to the position of the float. When the level of fuel in the float chamber of the carburetor is low, the actuator moves away from the needle. Fuel from the fuel supply is slightly pressurized so that when the float is no longer acting on the needle, the fuel pushes the needle away from the seat so that fuel can flow between the needle and the seat and from the inlet, through the interior region, past the needle, to the outlet.

Once the float has moved away from the needle, the force of the fuel against the needle is of a sufficient duration that there is time for fuel to flow through the gap and allow the needle to move from the closed position to the open position. Likewise, when the fuel level in the float chamber is restored to the predetermined maximum level, the float pushes the needle to the closed position. The force applied against the needle by the float is of a sufficient duration that there is time for fuel to flow through the gap and allow the needle to move from the open position to the closed position. Thus, the skirt cooperates with the side wall to couple the needle to the seat and to the housing so that the needle moves with the seat and the housing as the housing vibrates in response to the vibration of the engine while at the same time allowing movement of the needle relative to the seat and the housing in response to movement of the float in the float chamber.

As described above, the fuel from the fuel supply is pressurized and exerts a force against the tip of the needle to move the needle from the closed position toward the open position. In conventional fuel inlet valves, as the tip of the needle moves away from the seat, the force acting against the tip of the needle rapidly dissipates. In such conventional fuel inlet valves the outlet typically has a fixed size that is large to minimize the build up of fuel pressure in the housing and thus to maximize the flow of fuel through both the inlet and the outlet of the housing.

The needle and seat valve assembly in accordance with the present invention includes the skirt as described above. In preferred embodiments, the skirt is axially positioned to lie adjacent to the outlet so that the skirt restricts the flow of fuel through the outlet reducing the effective size of the outlet when the needle is in the closed position. Restricting the flow of fuel through the outlet causes the build-up of "residual operating pressure" acting on the skirt of the needle and tending to move the needle to the open position.

As with conventional needle and seat assemblies, as the tip of the needle of the needle and seat assembly in accordance with the present invention moves away from the seat, the pressure acting on the tip rapidly dissipates. However, the residual operating pressure acts on the skirt and continues to apply a force to the skirt tending to move the needle toward the open position. In addition, while the space between the needle and the seat initially restricts the flow of fuel through the inlet and reduces the pressure head of the fuel flowing therethrough, as the needle moves toward the open position the space between the needle and the seat widens, reducing the flow restriction, and increasing the pressure head of the fuel flowing into the housing.

As the needle moves away from the seat and the size of the opening between the tip of the needle and the seat increases, the skirt moves relative to the outlet increasing the effective size of the outlet so that the flow of fuel through the outlet also increases. The increased flow of fuel through the inlet, however, is sufficient to sustain the force acting on the skirt so that even when the needle is in the open position, the force of the fuel acting on the skirt yieldably biases the needle toward the open position. At the same time, having the skirt moved away from the outlet maximizes the flow of fuel through the outlet. Thus, the skirt cooperates with the outlet to define a "variable outlet orifice" operating to maintain residual operating pressure acting on the skirt and the needle to yieldably bias the needle away from the closed position, even when the housing vibrates.

If desired, the needle and seat valve assembly in accordance with the present invention can also be provided with a bottom cap including an edge defining an opening in the bottom cap. A post extends from the bottom of the needle through the opening in the bottom cap. The post and the edge of the opening of the bottom cap define a second gap and the post cooperates with the edge to restrict the flow of fuel through the second gap, just as the skirt and the side wall of the housing cooperate to restrict the flow of fuel through the first gap.

The bottom cap cooperates with the post, the skirt, and the side wall to define a coupling chamber that contains fuel during the operation of the needle and seat valve assembly. Since the bottom cap is fixed to the housing and the skirt is fixed to the needle, the volume of the coupling chamber changes as the needle moves relative to the housing. As a result, when the needle moves relative to the housing, fuel must flow into and out of the chamber between the first and second gaps. The restriction of the flow of fuel into and out of the coupling chamber through the first and second gaps operates to couple the needle to the housing so that the needle moves with the housing as the housing rapidly vibrates in response to the operation of the engine while allowing movement of the needle relative to the housing in response to the slower movement of the float in the float chamber.

It should be noted that the pressure of the fuel in the coupling chamber acts against the skirt tending to move the skirt toward the closed position. Thus, providing the needle and seat valve assembly with the bottom cap reduces the force tending to hold the needle in the open position. However, the gap between the skirt and the housing restricts the flow of fuel into the coupling chamber so that the pressure of the fuel in the coupling chamber and the force acting to move the skirt and needle toward the closed position is less than the force tending to hold the skirt and needle open.

It can be seen that the needle and seat valve assembly in accordance with the present invention includes a housing having an inlet, an outlet in fluid communication with the inlet, an interior region therebetween, and a bottom opening in fluid communication with the interior region. A needle is received in the interior region of the housing for movement relative thereto between a closed position blocking the flow of fuel between the inlet and the outlet and an open position allowing the flow of fuel between the inlet and the outlet. A partitioning mechanism is connected to the needle for dividing the interior region into a first portion communicating with the fuel supply via the inlet and a second portion communicating with the fuel chamber of the carburetor via the bottom opening. The partitioning mechanism includes a mechanism for restricting communication between the first portion and the second portion of the interior region.

Additional objects, features and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
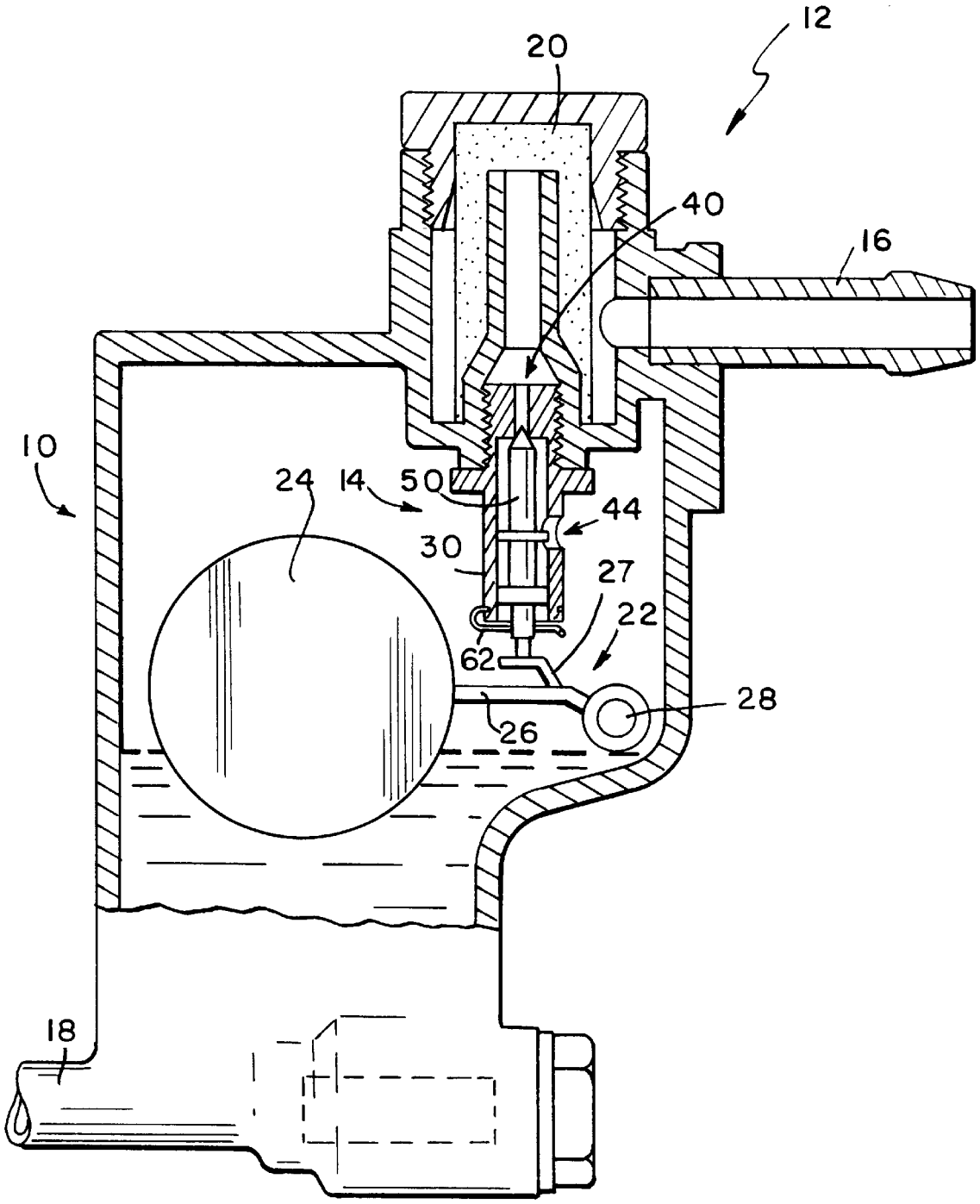
FIG. 1 is a sectional view of a carburetor float chamber of an engine including a needle and seat valve assembly in accordance with the present invention for controlling the flow of fuel from a fuel supply (not shown) through a fuel supply port and into the float chamber, the needle and seat valve assembly including a housing threadably coupled to a wall of the float chamber, a needle movable in the housing between a closed position blocking the flow of fuel from the fuel supply port into the float chamber and an open position allowing the flow of fuel into the float chamber, the needle being movable in response to the position of a float arm having a first end connected to a float and a second and that is pivotably coupled to a side wall of the float chamber for movement between an upward full position and a downward filling position, the float arm including an actuating member engaging the needle and applying a contact force thereto in response to upward movement of the float arm to move the needle to the upward closed position when the float arm is in the full position, the actuating member moving away from the needle so that the pressurized fuel operates to move the needle to the downward open position when the float arm is in the filling position.

A float chamber 10 of carburetor 12 is provided with a needle and seat valve assembly 14 in accordance with the present invention as shown in FIG. 1 to control the flow of fuel from a fuel supply (not shown) into float chamber 10. Float chamber 10 includes a fuel inlet 16 in fluid communication with the fuel supply (not shown) and a fuel outlet 18 supplying fuel from float chamber 10 to a main fuel jet (not shown) of carburetor 12.

Figure 2:
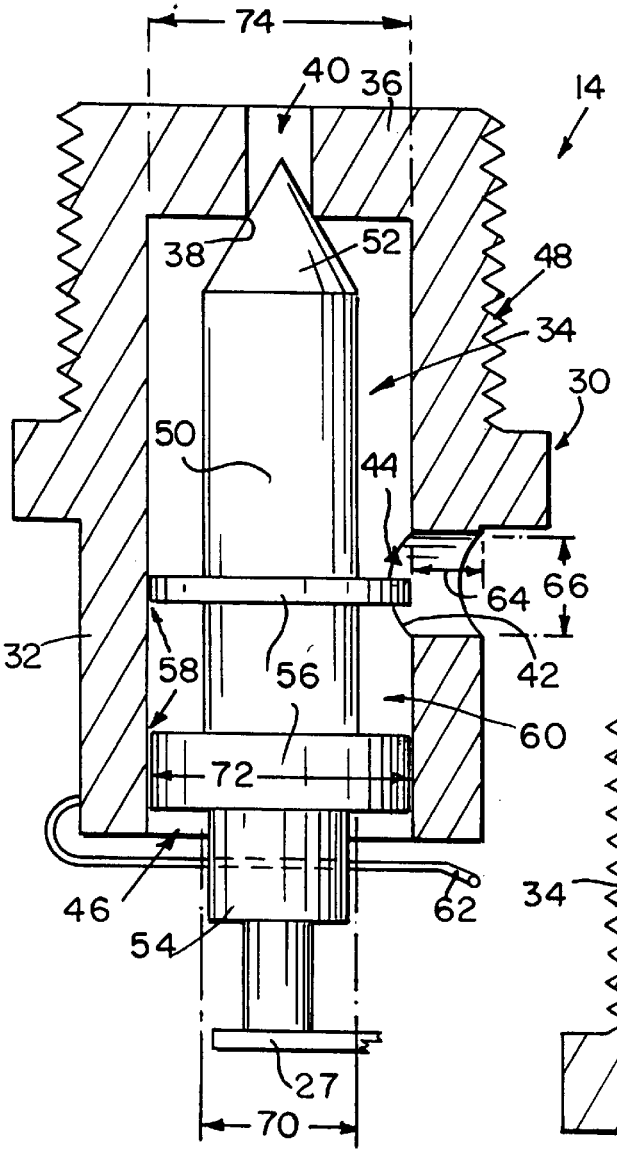
FIG. 2 is a sectional view of the needle and seat valve assembly of FIG. 1 showing a housing having a top wall defining an axially extending inlet and a side wall defining a cylindrically-shaped and axially-extending interior region, a radially extending outlet in fluid communication with the inlet through the interior region, and an axially-extending bottom opening, a tip of the needle sealingly engaging a seat formed in the housing adjacent to the inlet when the needle is in the closed position blocking the flow of fuel through the inlet, the needle being formed to include a skirt that is fixed to the needle and that extends radially outwardly therefrom to define a gap between the skirt and the side wall, the skirt cooperating with the side wall to restrict the flow of fuel through the gap, the skirt being formed to include an annular channel to minimize the weight of the needle, and the skirt being axially positioned to restrict the flow of fuel through the outlet when the needle is in the closed position.
Figure 3:
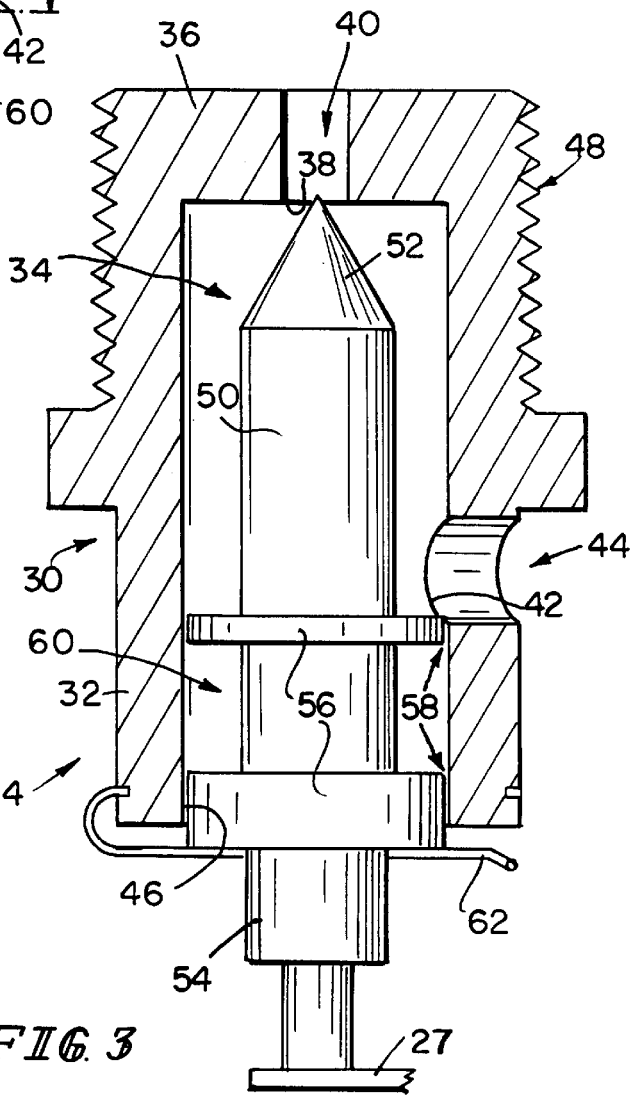
FIG. 3 is a view similar to FIG. 2 showing the needle moved to the open position having the tip of the needle spaced apart from the seat of the housing to allow the unrestricted flow of fuel therebetween, the skirt being moved away from the outlet to minimize the effect of the skirt on the flow of fuel through the outlet when the needle is in the open position so that the "effective size" of the outlet is the full size of the opening when the needle is in the open position.
Figure 4:
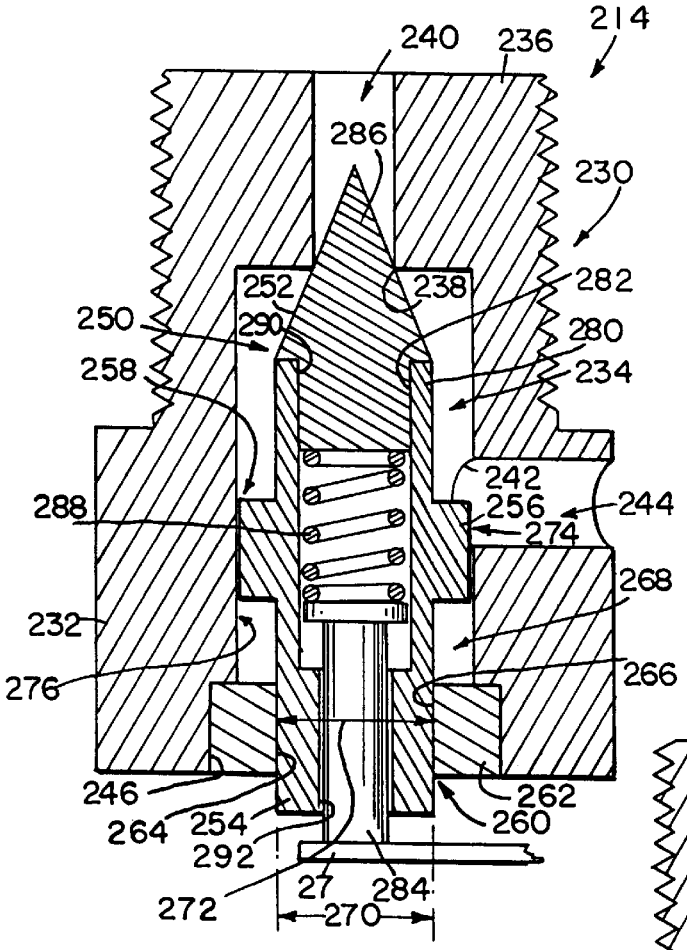
FIG. 4 is a view of a second embodiment of a needle and seat valve assembly in accordance with the present invention showing a bottom cap press fit into a cavity formed in the housing, the bottom cap including an edge defining an opening receiving the needle therethrough and defining a second gap between the needle and the edge of the bottom cap, the bottom cap cooperating with the needle to restrict the flow of fuel through the second gap and the bottom cap cooperating with the skirt and the housing to define a coupling chamber receiving fuel and coupling the needle to the housing for movement therewith in response to vibration of the engine.
Figure 5:
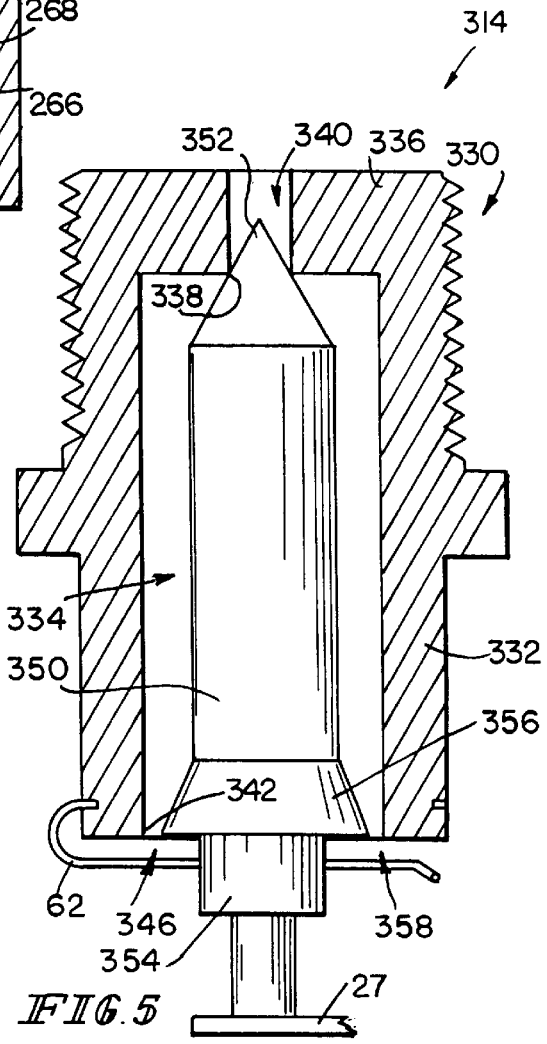
FIG. 5 is a view similar to FIG. 4 of a third embodiment of a needle and seat valve assembly in accordance with the present invention showing a housing including a top wall defining a generally axially extending inlet and a side wall defining a generally cylindrical interior region and a generally axially-extending outlet in fluid communication with the inlet through the interior region, the needle including an outwardly angling skirt cooperating with the housing to define a gap therebetween, the size of the gap between the outlet and the skirt increasing as the needle moves from the closed position to the open position to increase the effective size of the outlet as the needle moves toward the open position.

An illustrative first embodiment of a needle and seat valve assembly 14 in accordance with the present invention is shown in FIGS. 2 and 3, an illustrative second embodiment of a needle and seat valve assembly 214 in accordance with the present invention is shown in FIG. 4, and an illustrative third embodiment of a needle and seat valve assembly 314 in accordance with the present invention is shown in FIG. 5. Although illustrative carburetor 12 shown in FIG. 1 includes float chamber 10 for regulating fuel delivery to the main fuel jet, needle and seat valve assemblies 14, 214, 314 in accordance with the present invention can also be used with other types of carburetors, for example with carburetors (not shown) of the type including a fuel chamber storing pressurized fuel for delivery to the main fuel jet.

Fuel from the fuel supply flows from fuel inlet 16, through a filter 20, and into float chamber 10 through needle and seat valve assembly 14 as shown in FIG. 1. A float assembly 22 cooperates with needle and seat valve assembly 14 to maintain the fuel level in float chamber 10 between a predetermined maximum level and a predetermined minimum level. Float assembly 22 includes a float 24 coupled to float chamber 10 by a float arm 26 that is fixed to float 24 and that is pivotably coupled to float chamber 10 by a pin 28 as illustratively shown in FIG. 1. Float 24 is buoyed by the fuel in float chamber 10 and is movable between a full position when the level of fuel in float chamber 10 is at the predetermined maximum level and a filling position when the level of fuel in fuel chamber 10 is at the predetermined minimum level.

An actuating member 27 is fixed to float arm 26 as shown in FIG. 1. Actuating member 27 engages needle and seat valve assembly 14 so that as fuel is used by the engine and the level of fuel in float chamber 10 lowers to the predetermined minimum fuel level, float 24 lowers in float chamber 10 and pivots float arm 26 downwardly. As float arm 26 pivots downwardly, actuating member 27 moves downwardly opening needle and seat valve assembly 14 and allowing the flow of fuel from fuel inlet 16 through needle and seat valve assembly 14 and into float chamber 10. When the fuel level in float chamber 10 is restored to the predetermined maximum fuel level, float 24 pivots float arm 26 upwardly, moving actuating member 27 upwardly so that actuating member 27 applies a contact force to needle and seat valve assembly 14 closing needle and seat valve assembly 14 to block the flow of fuel into float chamber 10.

Needle and seat valve assembly 14 includes housing 30 having a side wall 32 that, in preferred embodiments, defines a generally cylindrically-shaped interior region 34 as illustratively shown in FIG. 2. An outer surface 48 of side wall 32 is threaded so that housing 30 can threadably engage a wall of float chamber 10 when installed into float chamber 10. Side wall 32 is also formed to include an edge 42 defining a generally radially-extending outlet opening 44 and side wall 32 additionally defines a generally axially-extending bottom opening 46. Housing 30 additionally includes a top wall 36 having an edge 38 defining a generally axially-extending inlet opening 40.

A needle 50 is received in interior region 34 of housing 30 for movement therein between a closed position, shown in FIG. 2, having a tip 52 of needle 50 sealingly engaging edge 38 of inlet opening 40 to block the flow of fuel therethrough and to block the flow of fuel between inlet opening 40 and outlet opening 44, and an open position, shown in FIG. 3, having tip 52 of needle 50 spaced-apart from edge 38 allowing the flow of fuel between edge 38 and tip 52 of needle 50, through inlet opening 40, through interior region 34 of housing 30, and out of needle and seat valve assembly 14 through outlet opening 44 to float chamber 10. It can be seen that edge 38 of inlet opening 40 operates as a valve seat sealingly engaging tip 52 of needle 50 when needle 50 is in the closed position. Hereinafter edge 38 will be referred to as valve seat 38 or simply seat 38.

Needle 50 additionally includes a post 54 extending axially downwardly from tip 52. Preferably, post 54 engages actuating member 27 of float arm 26 so that as the fuel level in float chamber 10 decreases and float 24 moves away from the full position, float arm 26 pivots downwardly and actuating member 27 moves downwardly, possibly disengaging from post 54, and allowing needle 50 to move away from the closed position and toward the open position. When the fuel level in float chamber 10 increases and float 24 moves away from the filling position, float arm 26 pivots upwardly moving actuating member 27 upwardly engaging post 54 and moving needle 50 upwardly away from the open position and toward the closed position. If desired, a retaining device such as a wire keeper 62 can be fixed to housing 30 for limiting the downward movement of needle 50 away from seat 38 as shown in FIG. 2.

Needle 50 is also formed to include an annular skirt 56 that is fixed to needle 50 and that extends axially outwardly therefrom toward side wall 32 as shown in FIG. 2. Skirt 56 and side wall 32 are configured so that an annular gap 58 is formed therebetween. Skirt 56 and side wall 32 cooperate to restrict the flow of fuel through gap 58. If desired, skirt 56 can be formed to include an annular channel 60 to reduce the mass of needle 50 so that the inertial forces acting on needle 50 are minimized.

In the illustrative and preferred needle and seat valve assembly 14, needle 50 has a diameter 70 of 0.150 inches (3.81 mm), skirt 56 has a diameter 72 of 0.226 inches (5.74 mm), and side wall 32 of housing 30 has an inner diameter 74 of 0.230 inches (5.84 mm). The preferred difference between inner diameter 74 of housing 30 and diameter 72 of skirt 56 is thus 0.004 inches (0.1 mm) so that the preferred gap 58 between skirt 56 and side wall 32 is 0.002 inches (0.05 mm). It is believed that gap 58 of 0.002 inches (0.05 mm) is approximately as small as gap 58 can be made using relatively inexpensive and conventional manufacturing and machining techniques while ensuring that needle 50 can freely move between the open and closed positions.

It has been found that if skirt 56 and side wall 32 are made so that gap 58 is less than 0.002 inches (0.05 mm) then manufacturing irregularities can prevent needle 50 from moving freely relative to housing 30 so that tip 52 occasionally fails to sealingly engage seat 38 properly when needle 50 is in the closed position. While preferred gap 58 is 0.002 inches (0.05 mm), the size of gap 58 can be varied without exceeding the scope of the invention as presently perceived so long as housing 30 and skirt 56 cooperate to restrict the flow of fuel through gap 58 to couple needle 50 to housing 30 so that needle 50 vibrates with housing 30 in response to vibration of the engine while also allowing movement of needle 50 relative to housing 30 in response to movement of float 24 relative to float chamber 10.

While interior region 34 of preferred housing 30 is generally cylindrical and preferred skirt 56 is annular so that gap 58 is annular, interior region 34 can have a cross-sectional shape that is not round and skirt 56 can have a corresponding shape without exceeding the scope of the invention as presently perceived so long as skirt 56 and housing 30 cooperate to define gap 58 as described above and so long as housing 30 and skirt 56 cooperate to restrict the flow of fuel through gap 58 to couple needle 50 to housing 30 so that needle 50 vibrates with housing 30 in response to vibration of the engine while also allowing movement of needle 50 relative to housing 30 in response to movement of float 24 relative to float chamber 10. For example, it is within the scope of the invention as presently perceived to provide interior region 34 with a generally square cross-section and to provide a generally square skirt 56 so that housing 30 and skirt 56 cooperate to define a generally square gap 58 therebetween.

In preferred embodiments, needle 50 can be made from steel, brass, aluminum, plastics materials, or other suitable materials without exceeding the scope of the invention as presently perceived. If desired, tip 52 can be a separate piece made from synthetic rubber such as Viton™, a plastics material made by E. I. duPont deNemours, which can be attached to a barb (not shown) formed on the top of needle 50 by pressing and gluing the Viton™ tip 52 into place. Preferably, the material from which needle 50 is made is selected so that the mass of needle 50 is minimized, minimizing the inertia of needle 50.

Needle and seat valve assembly 14 is configured so that pressurized fuel from the fuel supply flows from fuel inlet 16 to float chamber 10 through needle and seat valve assembly 14. The fuel has a slight pressure head so that the pressurized fuel acts on tip 52 to yieldably bias needle 50 away from the closed position and toward the open position. Thus, during the operation of the engine when float arm 26 pivots downwardly, the pressurized fuel pushes tip 52 and needle 50 from the closed position toward the open position.

However, in addition to being subjected to forces exerted by the pressurized fuel and by float arm 26, needle and seat valve assembly 14 is fixed to carburetor 12 which is fixed to an engine that vibrates during the operation of the engine. While carburetor 12 and housing 30 are directly coupled to the engine so that these vibrations are transmitted from the engine to housing 30, needle 50 is not directly coupled to the engine. Instead, for conventional fuel inlet valves, as the housing vibrates, the inertia of the needle inhibits like vibration of the needle so that, at least at certain engine operation frequencies, the housing vibrates relative to the needle.

In effect, when the float arm of a conventional carburetor pivots downwardly so that the needle can move from the closed position to the open position, vibration of the housing relative to the needle causes oscillation of the needle so that the needle "chatters" or moves rapidly between the closed position and the open position. Thus, rather than allowing the free flow of fuel from the fuel supply, through the fuel inlet, and into the float chamber as would occur absent the vibration of the housing, the chattering of the needle interrupts the flow of fuel between the inlet opening of the conventional fuel inlet valve and the outlet opening so that there is an inadequate flow of fuel into the float chamber. This reduction of fuel delivered to the engine, particularly when the fuel requirements of the engine are highest as the engine operates at high operating frequencies, can result in a loss of power to the engine, can result in otherwise poor engine performance, or can even result in engine damage.

Conventional needles of conventional fuel inlet valve assemblies are typically streamlined to maximize the flow of fuel through the conventional fuel inlet valve assembly. As a result, the needle is "free floating" relative to the housing under most conditions and the engine vibrations have a significant effect on the movement of the needle relative to the seat. It should be noted, however, that the undesired movement of the conventional needle relative to the housing, namely the chattering of the needle in the housing in response to the engine vibration, occurs at a much greater frequency and thus for a much shorter cycle time than the desired movement of the needle relative to the housing in response to the movement of the float and the float arm in the float chamber.

Skirt 56 of needle and seat valve assembly 14 in accordance with the present invention operates to inhibit the undesired chattering of needle 50 in housing 30 in response to engine vibration without significantly affecting the desired movement of needle 50 relative to housing 30 in response to movement of float 24. Skirt 56 cooperates with side wall 32 both to maintain a "residual operating pressure" acting on needle 50 and tending to bias needle 50 toward the open position, even when housing 30 vibrates in response to vibration of the engine, and by coupling needle 50 to housing 30 so that the movement of needle 50 relative to housing 30 is dampened sufficiently so that needle 50 moves with housing 30 in response to vibrations of the engine.

As described above, the fuel entering inlet opening 40 is pressurized and exerts a force against tip 52 of needle 50 to move needle 50 away from inlet opening 40. However, as needle 50 moves away from inlet opening 40, the size of the opening defined between tip 52 of needle 50 and seat 38 of inlet opening 40 increases and the pressure exerted against tip 52 of needle 50 by the fuel rapidly dissipates. However, skirt 56 is preferably axially positioned to lie adjacent to outlet opening 44 so that skirt 56 restricts the flow of fuel through outlet opening 44 as shown in FIG. 2. Having skirt 56 restrict the flow of fuel through outlet opening 44 and thus reduce the "effective size" of outlet opening 44 causes the build-up of fuel residual operating pressure in interior region 34 of housing 30.

As needle 50 moves away from the closed position and toward the open position shown in FIG. 3, skirt 56 moves away from outlet opening 44 and the effective size of outlet opening 44 increases so that skirt 56 and outlet opening 44 define a "variable outlet orifice." When the effective size of outlet opening 44 is small, the flow of fuel through outlet opening 44 is minimized so that fuel having a residual operating pressure accumulates in interior region 34 of housing 30.

In addition, as tip 52 of needle 50 initially starts to move away from seat 38, the opening formed between tip 52 and seat 38 is small and restricts the flow of fuel into interior region 34 of housing 30 reducing the pressure head of the fuel flowing into interior region 34. As tip 52 moves further from seat 38, the opening between tip 52 and seat 38 widens, the restriction of the flow of fuel into interior region 34 is lessened, and the reduction of the pressure head of fuel flowing into interior region 34 is diminished so that the pressure head of the fuel flowing into interior region 34 increases.

At the same time, when tip 52 of needle 50 initially starts to move away from seat 38, skirt 56 restricts the flow of fuel through outlet opening 44 allowing for the build-up of residual operating pressure in interior region 34. As tip 52 moves further from seat 38, skirt 56 moves away from outlet opening 44 to lessen its restriction of the flow of fuel through outlet opening 44. However, the increasing pressure head of the fuel flowing into interior region 34 compensates for increasing the effective size of outlet opening 44 as needle 50 moves toward the open position so that the fuel in interior region 34 has a residual operating pressure at each position of needle 50 relative to housing 30 between the open position and the closed position.

The residual operating pressure operates on skirt 56 to yieldably bias needle 50 away from the closed position. The presence of the residual operating pressure in interior region 34 tends to keep tip 52 of needle 50 away from seat 38, even when housing 30 vibrates in response to operation of the engine. Thus, the variable outlet orifice allows for the retention of fuel having the residual operating pressure in interior region 34 of housing 30 which acts on skirt 56 to yieldably bias needle 50 away from the closed position and tending to keep needle and seat assembly 14 open, even when housing 30 vibrates in response to operation of the engine.

Figure 7:
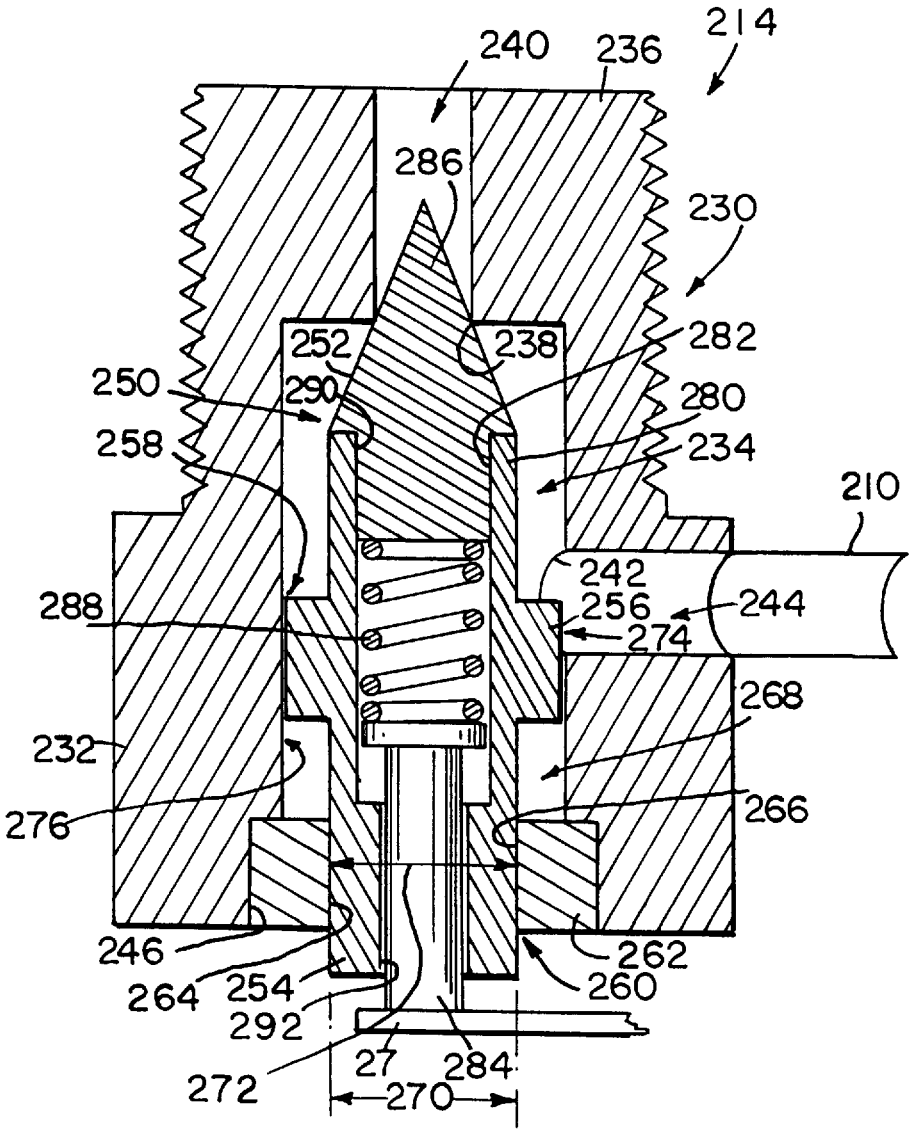

While conventional fuel inlet valves are generally formed to maximize the flow of fuel through their outlets, outlet opening 44 can be configured to restrict the flow of fuel therethrough to develop residual pressure in interior region 34 even without positioning skirt 56 adjacent to outlet opening 44. Outlet opening 44 is formed to include a diameter 66 and a length 64 preferably extending radially relative to interior region 34. The flow through outlet opening 44 can be reduced forming a restricted orifice by either reducing the size of diameter 66, thereby reducing the cross-sectional area of outlet opening 44, or by increasing length 64 of outlet opening 44. If desired, an extension conduit 210 can be appended to housing 30 to increase the "effective length" of outlet opening 44 in order to further increase the residual operating pressure as shown in FIG. 7.

When outlet opening 44 is a restricted orifice, a pressure drop forms across the outlet opening 44 so that the fuel in interior region 34 has residual operating pressure acting against skirt 56 to yieldably bias skirt 56 away from the closed position. If desired, outlet opening 44 can be formed as a restricted orifice to produce a residual operating pressure in interior region 34 and skirt 56 can be axially positioned adjacent to outlet opening 44 so that outlet opening 44 is both a restricted orifice and a variable outlet orifice.

Thus, sustaining the residual operating pressure in interior region 34 of housing 30 can limit the effect of engine vibration on the flow of fuel through needle and seat valve assembly 14 by acting on skirt 56 to yieldably bias needle 50 toward the open position. The effect of engine vibration can also be minimized by coupling needle 50 to housing 30 so that needle 50 cannot move quickly enough relative to housing 30 in response to the vibration of housing 30 to significantly affect the position of needle 50 relative to seat 38. Of course, to operate effectively, needle 50 must at the same time be movable relative to housing 30 in response to movement of float 24 relative to float chamber 10.

As described above, skirt 56 cooperates with side wall 32 of housing 30 to restrict the flow of fuel through gap 58. If housing 30 vibrates, the inertia of needle 50 and the movement of housing 30 attempt to move needle 50 rapidly from the open position of FIG. 3 toward the closed position of FIG. 2. As needle 50 moves relative to housing 30, the fuel in interior region 34 of housing 30 between skirt 56 and inlet opening 40 must flow either out of outlet opening 44 or through gap 58 so that needle 50 can move relative to housing 30. As skirt is pushed closer to top wall 36 of housing 30, the fuel in interior region 34 will act between housing 30 and skirt 56 to prevent the rapid movement of needle 50.

Thus, as vibration of the engine during a vibration cycle moves housing 30 in a first direction, inertia of needle 50 tends to prevent movement of needle 50 with housing 30 so that needle 50 tends to move relative to housing 30. However, the movement of needle 50 relative to housing 30 from the open position of FIG. 3 to the closed position of FIG. 2 is slowed because such movement requires the flow of additional fuel through outlet opening 44 or the flow of fuel through gap 58. As a result, before needle 50 can move a significant distance toward seat 38 in response to vibration of the engine, the vibration cycle reverses and the engine vibration moves housing 30 in a second direction that is opposite the first direction so that the inertia of needle 50 tends to move needle 50 relative to housing 30 back toward the open position. Again the fuel in interior region 34 operates to slow the movement of needle 50 relative to housing 30 and before needle 50 can move a significant distance toward the open position, the vibration cycle once again reverses tending once again to move needle 50 relative to housing 30 toward the closed position. Thus, side wall 32 of housing 30 cooperates with skirt 56 to restrict the flow of fuel through gap 58 and couple needle 50 to housing 30 so that needle 50 does not chatter in response to vibration of the engine.

However, when the level of fuel in float chamber 10 decreases to move float 24 from the upward full position to the downward filling position, float arm 26 moves from the full position to the filling position. When float arm 26 is in the filling position, actuating member 27 moves downwardly allowing needle 50 to move from the closed position to the downward open position in response to the force of the pressurized fuel from the fuel supply acting on needle 50. The force of the pressurized fuel acts consistently on needle 50 and float 24 remains in the filling position for a sufficient duration to allow fuel to flow through gap 58 so that needle 50 can move to the open position in response to movement of float 24 to the filling position.

When float 24 moves to the full position, float arm 26 and actuating member 27 engage needle 50 and exert a contact force thereon to yieldably bias needle 50 toward the closed position. The force of actuating member 27 acts consistently on needle 50 and float 24 remains in the full position for a sufficient duration to allow fuel to flow through gap 58 so that needle 50 moves to the closed position in response to movement of float 24 to the full position. Thus, while side wall 32 cooperates with skirt 56 to prevent the movement of needle 50 relative to housing 30 in response to the rapid vibration of the engine during operation of the engine, side wall 32 and skirt 56 allow the slow movement of needle 50 relative to housing 30 in response to the movement of float 24 relative to float chamber 10.

A second embodiment of a needle and seat valve assembly 214 in accordance with the present invention is illustratively shown in FIG. 4. Needle and seat valve assembly 214 is similar to needle and seat valve assembly 14 except that instead of having wire keeper 62 to retain needle 250 in interior region 234 of housing 230, a bottom cap 262 having an edge 264 defining an opening 266 receiving post 254 of needle 250 is attached to bottom opening 246 of housing 230. Preferably, bottom cap 262 is a bushing that is press fit into housing 230. Post 254 cooperates with edge 264 of bottom cap 262 to define a second gap 260 therebetween and post 254 cooperates with edge 264 to restrict the flow of fuel through second gap 260. Bottom cap 262, post 254, and skirt 256 of needle 250 cooperate with side wall 232 of housing 230 to define a variable-sized annular coupling chamber 268 of needle and seat valve assembly 214.

As needle 250 moves from the closed position to the open position, the volume of coupling chamber 268 decreases. Coupling chamber 268 contains fuel and as the volume of coupling chamber 268 decreases fuel flows out of coupling chamber 268 through a gap 258 defined between skirt 256 and side wall 232 of housing 230 as well as through second gap 260 defined between edge 264 of bottom cap 262 and post 254 of needle 250. The speed with which needle 250 can move between the closed position and the open position is limited by the flow rate of fuel through gaps 258, 260. Skirt 256 and edge 264 of bottom cap 262 are thus sized so that needle 250 cannot move a significant distance within interior region 234 of housing 230 during the time of one-half of a vibration cycle at typical engine operation frequencies. Thus, coupling chamber 268 operates to couple needle 250 to housing 230 so that needle 250 moves with housing 230 as housing 230 vibrates in response to operation of the engine.

In the illustrative and preferred needle and seat valve assembly 214, needle 250 has a diameter 270 of 0.150 inches (3.81 mm) and opening 266 of bottom cap 262 has a diameter 272 of 0.154 inches (3.91 mm). The difference between diameter 272 of opening 266 of bottom cap 262 and diameter 270 of needle 250 is 0.004 inches (0.1 mm) so that the preferred second gap 260 between needle 250 and bottom cap 262 is 0.002 inches (0.05 mm). While preferred second gap 260 is 0.002 inches (0.05 mm), the size of second gap 260 can be varied without exceeding the scope of the invention as presently perceived so long as bottom cap 262 and needle 250 cooperate to restrict the flow of fuel through second gap 260 to couple needle 250 to housing 230 so that needle 250 vibrates with housing 230 in response to vibration of the engine while also allowing movement of needle 250 relative to housing 230 in response to movement of float 24 relative to float chamber 10.

Another force operating to couple needle 250 to housing 230 is the viscous restraining force of the fuel. When two surfaces such as annular outer surface 274 of skirt 256 and annular inner surface 276 of housing 230 that are separated by a fluid layer, as shown in FIG. 4, move relative to one another, the viscosity of the fluid results in a viscous restraining force that resists the movement. The viscous restraining force is defined by the equation:

$$F = \eta \times A \times \frac{V}{L}$$

where:

F=the viscous restraining force

η=the viscosity of the fluid

A=the area of the two surfaces

V=the relative velocity of the surfaces, and

L=the separation of the surfaces (gaps 258, 260).

While it is not presently believed that the viscous restraining force is sufficient on its own to prevent the chattering of needle 250, it is believed that the viscous restraining force amounts to approximately 25% of the inertia of needle 250 under expected operating conditions during engine vibration so that the viscous restraining force contributes to the stability of needle 250 relative to housing 230. As can be seen by the equation, the effect of the viscous restraining force is diminished when the relative velocity is low, such as when needle 250 moves in response to movement of float 24 in float chamber 10. It can also be seen that minimizing gaps 258, 260 (L in the equation above) will maximize the viscous restraining force.

Preferably, needle 250 includes a hollow needle body 280 defining an interior region 282 as shown in FIG. 4. Preferred needle body 280 is generally cylindrical and is formed to include an upper opening 290 and a lower opening 292. A tip member 286 defining tip 252 of needle 250 is press fit into upper opening 290 and interior region 282 of needle 250, a plunger 284 is slidably received in lower opening 292 and interior region 282 of needle 250 and extends axially downwardly therefrom, and a compression dampening spring 288 is positioned to lie therebetween to yieldably bias plunger 284 downwardly away from tip member 286.

Plunger 284 engages actuating member 27 of float assembly 22 as shown in FIG. 4. Dampening spring 288 cooperates with plunger 284 to allow movement of actuating member 27 relative to tip 252 of needle 250 to cushion tip 252 from erratic movement of float 24, float arm 26, and actuating member 27 resulting from vibration of float 24, "sloshing" of fuel, or other movement of actuating member 27.

Preferably needle 250 is constructed to minimize the mass of needle 250 and thereby minimize the inertia of needle 250. While needle body 280 is preferably made from aluminum or plastics materials, tip member 286 is preferably made from a material such as stainless steel that is easily polished to ensure that tip 252 can sealingly engage seat 238 of housing 230. In addition, making tip member 286 from stainless steel or another relatively hard material minimizes the wear of tip 252 thereby increasing the useful life of needle and seat valve assembly 214.

As described above, when float arm 26 and actuating member 27 pivot downwardly away from the closing position, needle 250 moves away from the closed position and toward the open position in response to force exerted thereon by the pressurized fuel. As the pressurized fuel forces needle 250 away from the closed position, fuel flows out of coupling chamber 268 through gap 258, 260 until needle 250 is in the open position and fuel can flow from fuel inlet 16 to float chamber 10 through inlet opening 240, interior region 234, and outlet opening 244 of needle and seat valve assembly 214.

Once sufficient fuel flows into float chamber 10 to raise the fuel level to the predetermined maximum fuel level moving float 24 upwardly and pivoting float arm 26 and actuating member 27 from the opening position to the closing position, needle 250 moves upwardly from the open position to the closed position. As needle 250 moves upwardly, coupling chamber 268 increases in volume and fuel flows through gap 258 into coupling chamber 268 to accommodate the volume increase. It will be understood by those skilled in the art that the movement of needle 250 between the closed position and the open position in response to movement of float 24 and float arm 26 is much slower movement and is of much longer duration than each vibration cycle of housing 230 in response to operation of the engine. Skirt 256, post 254 of needle 250, edge 264 of opening 266 of bottom cap 262, and side wall 232 of housing 230 are sized so that gaps 258, 260 can allow the flow of fuel therethrough to permit movement of needle 250 in response to movement of float 24. Thus, skirt 256 cooperates with side wall 232, post 254, and bottom cap 262 to couple needle 250 to housing 230 so that needle 250 moves with housing 230 in response to vibration resulting from operation of the engine while also allowing needle 250 to move independently of housing 230 in response to movement of float arm 26.

As described above with reference to FIGS. 2 and 3, the residual operating pressure acts on skirt 256 of needle 250 to yieldably bias needle 250 toward the open position. However, needle and seat valve assembly 214 includes bottom cap 262 and coupling chamber 268 as shown in FIG. 4. Coupling chamber 268 typically contains fuel that will operate to exert pressure against skirt 256 opposing the force exerted by the residual operating pressure. While the pressure exerted by the fuel in coupling chamber 268 has not been found to effect the flow of fuel through needle and seat valve assembly 214 during vibration of housing 30, it has been found that including bottom cap 262 improves the ability of needle and seat valve assembly 250 to block the flow of fuel at higher fuel pressures to float chamber 24 when desired.

Needle and seat valve assemblies 14, 214 were tested in a carburetor by subjecting them to increasing fuel inlet pressures. It was found that needle and seat valve assembly 14 blocked the flow of fuel having an inlet pressure of 3.5 psi but did not completely block the flow of fuel having an inlet pressure of 4.0 psi. Needle and seat valve assembly 214 was found to block the flow of fuel having an inlet pressure of 6 psi but did not completely block the flow of fuel having an inlet pressure of 7.5 psi. Thus, including bottom cap 262 improves the ability of needle and seat valve assembly 214 to sealingly engage seat 238 when the fuel from the fuel supply (not shown) is at elevated pressures.

A third embodiment of a needle and seat valve assembly 314 in accordance with the present invention is illustratively shown in FIG. 5. Needle and seat valve assembly 314 includes a housing 330 having a side wall 332 defining an interior region 334 of housing 330. Side wall 332 also includes a bottom edge 342 defining a generally axially-directed outlet opening 346. A top wall 336 of housing 330 is integrally appended to side wall 332 and top wall 336 includes an edge 338 defining an inlet opening 340.

A needle 350 including a generally upwardly-facing tip 352 and a generally downwardly-extending post 354 is received in interior region 334 for movement between a closed position in which tip 352 sealingly engages seat 338 of inlet opening 340 to block the flow of fuel therethrough and an open position having tip 352 spaced apart from seat 338 to form an opening therebetween restoring the flow of fuel from inlet opening 340 to outlet opening 346. Needle 350 is also formed to include a skirt 356 that is fixed to needle 350 and extends axially downwardly and radially outwardly therefrom to define a gap 358 between skirt 356 and side wall 332. Skirt 356 cooperates with side wall 332 to restrict the flow of fuel through gap 358.

It will be appreciated by those skilled in the art that as needle 350 moves away from the closed position and toward the open position gap, the size of gap 358 between skirt 356 and edge 342 of side wall 332 increases. It can be seen that this variable outlet orifice will operate in a similar manner to the variable outlet orifice of needle and seat valve assembly 14 described above with reference to FIGS. 2–4 so that the residual operating pressure acting on skirt 356 yieldably biases needle 350 toward the open position even during vibration of housing 330.

Needle and seat valve assemblies 14, 214, 314 are described above with respect to carburetor 12 including float chamber 10. However, needle and seat valve assemblies 14, 214, 314 can be used in other types of carburetors that include an actuator for operating a fuel inlet valve. For example, a carburetor (not shown) can include a pressurized fuel chamber supplying pressurized fuel to the carburetor, a diaphragm movable in response to the pressure of the fuel in the fuel chamber, and a lever and spring assembly having an actuator coupled to the diaphragm and engaging a fuel inlet valve so that movement of the diaphragm causes movement of the fuel inlet valve between the open position and the closed position. Needle and seat valve assemblies 14, 214, 314 in accordance with the present invention can be used as the fuel inlet valve controlling the flow of fuel in the above-described carburetor as well as for other types of known carburetors having an actuating member that moves in response to a preferred fuel condition.

Two conventional fuel inlet valves were compared to the first embodiment of needle and seat valve assembly 14 shown in FIGS. 2 and 3. The tests demonstrate that fuel flow reductions resulting from vibration are substantially reduced by use of needle and seat valve assembly 14. The first conventional valve that was tested ("Conventional Valve 1") was a valve model number VM28/163 valve made by Mikuni having a steel needle and a seat opening diameter of 1.5 mm (0.059 inches). The second conventional valve that was tested ("Conventional Valve 2") was a valve model number VM28/511 valve made by Mikuni having an aluminum needle, a Viton™ tip, and a seat opening diameter of 2.0 mm (0.079 inches). The tested needle and seat valve 14 in accordance with the present invention had an aluminum needle, a seat opening of 1.7 mm (0.067 inches), and an outlet opening of 2.4 mm (0.094 inches).

For testing purposes, water was provided for flow through each valve assembly having a head pressure of 1.5 psig ($1.04\times10^5$ dynes/cm$^2$). Each valve was mounted with the needle valve extending generally vertically. The flow through each valve was measured both with the valve assembly held stationary and with the valve assembly vibrated along the direction of needle travel. The flow measurements were made using a 150 mm Manostat number 4 flow gauge. The valves were each vibrated at 7800 cycles per minute with a peak-to-peak amplitude of 0.04 inches (1.0 mm).

Figure 6:
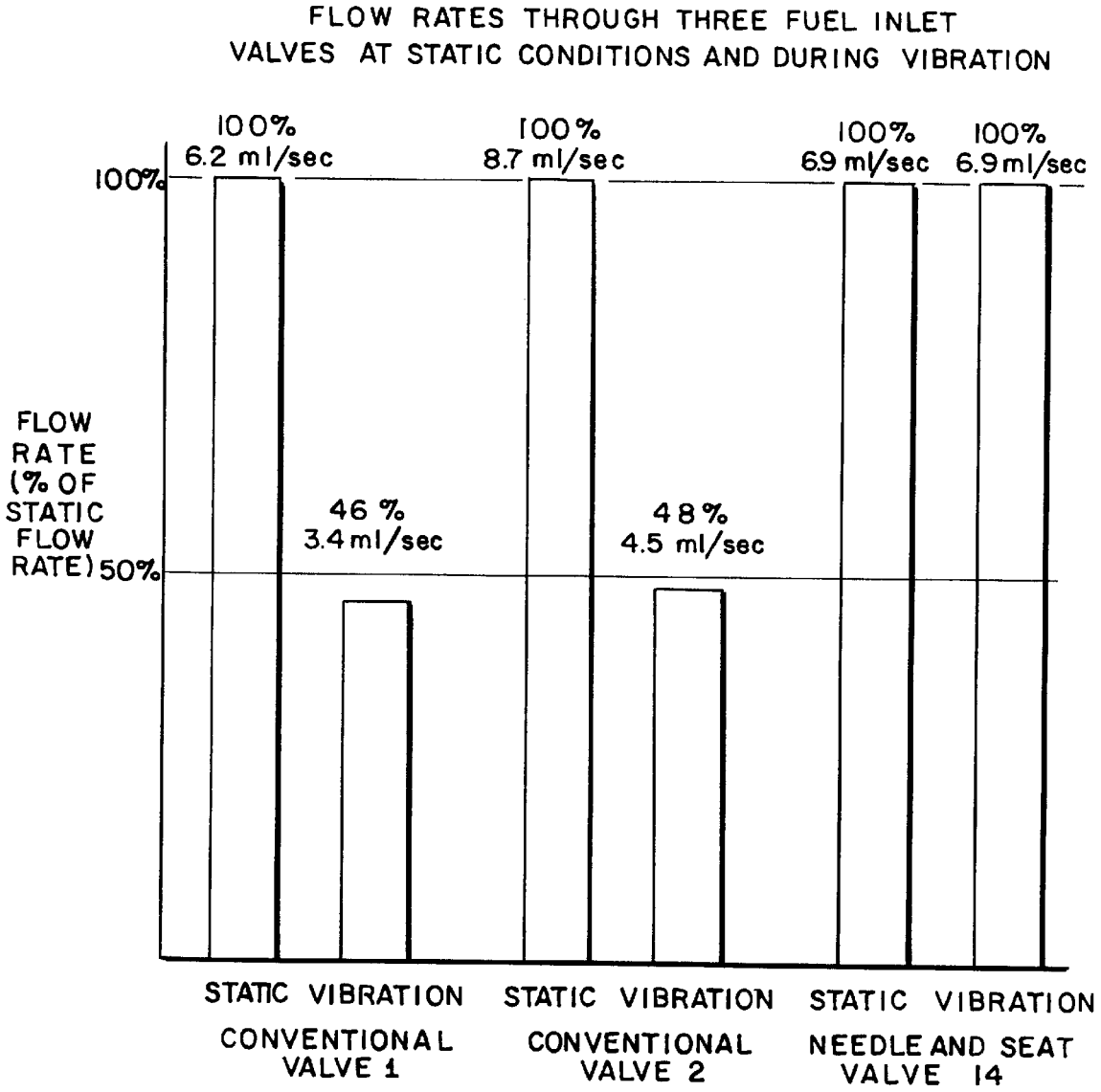
FIG. 6 is a chart graphically representing testing data showing the flow rate of fluid through fuel inlet valves and demonstrating a decrease of the flow rate through two conventional fuel inlet valves when the housings of the conventional valves are vibrated and demonstrating that the flow rate through a needle and seat valve assembly in accordance with the present invention is unaffected by vibration of the housing and FIG. 7 is a view similar to FIG. 4 showing an extension conduit extending out of the radially-extending outlet.

Conventional Valve 1 allowed water to flow through at a flow rate of 6.2 milliliters/second (ml/sec) without vibration and at a flow rate of 3.4 ml/sec with vibration so that vibration caused a 46% flow reduction as shown graphically in FIG. 6. Conventional Valve 2 allowed water to flow through at a flow rate of 8.7 ml/sec without vibration and a flow rate of 4.5 ml/sec with vibration so what vibration caused a 48% flow reduction. Needle and seat valve assembly 14 allowed water to flow through at a flow rate of 6.9 ml/sec without vibration and at a flow rate of 6.9 ml/sec with vibration so that no measurable flow reduction was found. Thus, needle and seat valve assembly 14 in accordance with the present invention allowed the same maximum flow of fluid through the valve both during static conditions and during vibration of housing 30.

Needle and seat valve assembly 214 was tested using the same set-up and equipment as described above except that the inlet head pressure of the fluid was held constant at a head pressure that differed from 1.5 psig. Needle and seat valve assembly 214 allowed the same maximum flow of fluid through the valve both during static conditions and during vibration of housing 230.

Although the invention has been described in detail with reference to preferred embodiments, additional variations and modifications exist within the scope and spirit of the invention as described and defined in the following claims.

I claim:

1. A valve assembly for controlling the flow of fuel to the fuel chamber of a carburetor, the valve assembly comprising a housing including a side wall defining an inlet, an outlet in fluid communication with the inlet, an interior region therebetween, and a needle received in the interior region of the housing for movement therein between a closed position blocking the flow of fuel between the inlet and the outlet and an open position allowing the flow of fuel between the inlet and the outlet, the needle including a post and a skirt fixed to the post and extending outwardly therefrom, the skirt cooperating with the side wall to restrict the flow of fuel therebetween dampening the movement of the needle relative to the housing so that the needle moves with the housing when the housing vibrates in response to the operation of the engine.

2. The valve of claim 1, wherein the housing is further formed to include an axially-extending bottom opening in fluid communication with the interior region and further comprising a bottom cap attached to the housing and covering the bottom opening, the bottom cap including an edge defining an opening receiving the needle, the needle and the edge defining a gap therebetween and cooperating to restrict the flow of fuel through the gap, the skirt, the side wall, the needle, and the bottom cap defining an annular coupling chamber.

3. The valve assembly of claim 1, further comprising an extension conduit appended to the housing and in fluid communication with the outlet so that the effective length of the outlet is increased by the extension conduit.

4. The valve assembly of claim 1, wherein the needle includes a generally cylindrical side wall defining hollow needle body having an upper opening, a lower opening, and an interior region therebetween.

5. The valve assembly of claim 4, wherein the needle further includes a tip received in the upper opening and the interior region of the hollow needle body, the tip engaging the inlet to restrict the flow of fuel therethrough when the needle is in the closed position.

6. The valve of claim 1, wherein the skirt is axially positioned to lie so that the skirt restricts the flow of fuel through the outlet when the needle is in the closed position and so that the skirt moves away from the outlet when the needle moves to the open position so that the outlet is a variable outlet orifice.

7. The valve of claim 6, wherein the inlet extends axially, the outlet extends generally radially, and the skirt moves axially when the needle moves between the open position and the closed position.

8. The valve of claim 6, wherein the inlet extends axially, the outlet extends axially, the skirt cooperates with the housing adjacent to the outlet to define a gap therebetween, and the skirt extends radially outwardly and is tapered axially so that the size of the gap changes as the needle moves between the open position and the closed position.

9. A valve assembly for controlling the flow of fuel from a fuel supply to a fuel chamber of a carburetor, the valve assembly comprising a needle, and a housing having an inlet, an outlet in fluid communication with the inlet, and an interior region therebetween receiving the needle for movement between a closed position blocking the flow between the inlet and the outlet and an open position allowing the flow of fluid between the inlet and the outlet, the needle including a post and a skirt fixed to the post and extending radially outward therefrom, and the skirt being positioned along the post to restrict the flow of fuel through the outlet so that the outlet and the skirt define the variable outlet orifice.

10. The valve assembly of claim 9, wherein the side wall of the housing is shaped so that the interior region is generally cylindrical and the outlet extends axially.

11. The valve assembly of claim 9, wherein the side wall of the housing is shaped so that the interior region is generally cylindrical and the outlet extends radially.

12. A valve assembly for controlling the flow of fuel from a fuel supply to a fuel chamber of a carburetor, the valve assembly comprising a needle, a housing including a wall defining an inlet opening, an outlet opening, and a generally cylindrical interior region between the inlet opening and the outlet opening, the interior region receiving the needle for movement between a closed position blocking the flow of fuel between the inlet and the outlet and an open position allowing the flow of fuel between the inlet and the outlet, the outlet opening extending generally radially from the interior region so that the interior region is in fluid communication with the fuel chamber of the carburetor through the outlet opening, means for restricting the flow of fuel through the outlet, the restricting means including the housing which is formed so that the length of the outlet opening is maximized, and an extension conduit appended to the housing and in fluid communication with the outlet opening so that the effective length of the outlet opening is increased by the extension conduit.

13. A valve assembly for controlling the flow of fuel from a fuel supply to a fuel chamber of a carburetor, the valve assembly comprising a needle, a housing including a wall defining an inlet opening, an outlet opening, and a generally cylindrical interior region between the inlet opening and the outlet opening, the interior region receiving the needle for movement between a closed position blocking the flow of fuel between the inlet and the outlet and an open position allowing the flow of fuel between the inlet and the outlet, the outlet opening extending generally radially from the interior region so that the interior region is in fluid communication with the fuel chamber of the carburetor through the outlet opening, and means for restricting the flow of fuel through the outlet, the restricting means including the housing which is formed so that the length of the outlet opening is maximized and an annular skirt fixed to the needle and extending radially outwardly therefrom.

14. A valve assembly for controlling the flow of fuel to the fuel chamber of a carburetor of an engine in response to the position of an actuator coupled to the fuel chamber, the valve assembly comprising a housing including an inlet, an outlet in fluid communication with the inlet, and an interior region therebetween, a needle received in the interior region of the housing and movable relative thereto between a closed position blocking the flow of fuel between the inlet and the outlet and an open position allowing the flow of fuel between the inlet and the outlet, and coupling means for coupling the needle to the housing so that the needle vibrates with the housing in response to vibration of the engine, the coupling means allowing movement of the needle relative to the housing in response to movement of the actuator relative to the fuel chamber, wherein the housing defines a bottom opening and the coupling means includes a bottom cap attached to the housing and covering the bottom opening, the bottom cap including an edge defying an opening receiving the needle, the needle and the edge defining a gap therebetween and cooperating to restrict the flow of fuel through the gap.

15. The valve assembly of claim 14, wherein the coupling means includes means for restricting the flow of fuel in the interior region of the housing.

16. The valve assembly of claim 14, wherein the housing includes a side wall defining the interior region and the needle cooperates with the side wall of the housing to define a gap therebetween, the restricting means including the portions of the needle and side wall defining the gap.

17. The valve assembly of claim 14, wherein the needle includes means for restricting the flow of fuel through the outlet so that the restriction varies as the needle moves between the open position and the closed position.

18. A valve assembly for controlling the flow of fuel from a fuel supply to a fuel chamber of a carburetor, the valve assembly comprising a housing having an inlet, an outlet in fluid communication with the inlet, an, interior region therebetween, and a bottom opening in fluid communication with the interior region, a needle received in the interior region of the housing for movement relative thereto between a closed position blocking the flow of fuel between the inlet and the outlet and an open position allowing the flow of fuel between the inlet and the outlet, and partitioning means connected to the needle for dividing the interior region into a first portion communicating with the fuel supply via the inlet and a second portion communicating with the fuel chamber of the carburetor via the bottom opening, the partitioning means including means for restricting communication between the first portion and the second portion of the interior region.

19. The valve assembly of claim 18, further comprising a bottom cap attached to the housing to cover the bottom opening, the bottom cap including an edge defining an opening, the needle extending through the opening of the bottom cap.

20. The valve assembly of claim 18, wherein the needle includes a post, the partitioning means includes a skirt fixed to the post and extending radially outwardly therefrom, and the skirt is positioned to lie on the post to restrict the flow of fuel through the outlet so that the outlet and skirt define the variable outlet orifice.

21. A valve assembly for controlling the flow of fuel to a fuel chamber of a carburetor, the valve assembly comprising a housing including an inlet, an outlet in fluid communication with the inlet, an interior region therebetween, and a bottom opening in fluid communication with the interior region, a bottom cap attached to the housing and covering the bottom opening, the bottom cap including an edge defining an opening adjacent the bottom opening of the housing, and a needle received in the interior region of the housing for movement relative thereto between a closed position blocking the flow of fuel between the inlet and the outlet and an open position allowing the flow of fuel between the inlet and the outlet, the needle including a post extending through the opening of the bottom cap and a skirt connected to the post and cooperating with the housing to restrict the flow of fuel therebetween so that the needle is coupled to the housing to move therewith in response to vibration of the housing.

22. The valve assembly of claim 21, wherein the interior region is generally cylindrical, the inlet and the bottom opening extend generally axially from the interior region, and the outlet extends generally radially from the interior region.

23. A valve assembly for controlling the flow of fuel to a fuel chamber of a carburetor, the valve assembly comprising a housing including a wall defining an inlet, an outlet in fluid communication with the inlet, and an interior region therebetween, a needle received in the interior region of the housing for reciprocating movement relative thereto, and partitioning means on the needle for partitioning the interior region into a first portion communicating with the inlet and a second portion, the partitioning means including an outer edge positioned in the interior region to define a clearance gap of about 0.002 inches (0.05 mm) between the wall of the housing and the outer edge during reciprocating movement of the needle in the interior region so that movement of the needle relative to the housing is dampened and the needle is coupled to the housing to move therewith in response to vibration of the housing.

24. The valve assembly of claim 23, wherein the needle includes a post defining a longitudinal axis extending in the direction that the needle reciprocates in the interior region of the housing and the annular outer edge of the partitioning means is positioned to lie in radially outwardly spaced-apart relation to the wall of the housing and concentric to the longitudinal axis of the needle.

25. The valve assembly of claim 23, wherein the interior region has a cross-section having a non-circular shape and the outer edge of the partitioning means has a corresponding non-circular shape.

* * * * *